US008678782B2

(12) United States Patent
Williams et al.

(10) Patent No.: US 8,678,782 B2
(45) Date of Patent: Mar. 25, 2014

(54) SUSPENSION SPRING FOR LINEAR COMPRESSOR

(75) Inventors: John Julian Aubrey Williams, Auckland (NZ); Gordon Cameron Otte, Auckland (NZ); Ian Campbell McGill, Auckland (NZ)

(73) Assignee: Fishe & Paykel Appliances Limited, Auckland (NZ)

( * ) Notice: Subject to any disclaimer, the term of this patent is extended or adjusted under 35 U.S.C. 154(b) by 1636 days.

(21) Appl. No.: 11/577,347

(22) PCT Filed: Nov. 1, 2005

(86) PCT No.: PCT/NZ2005/000288

§ 371 (c)(1),
(2), (4) Date: Dec. 12, 2007

(87) PCT Pub. No.: WO2006/049511

PCT Pub. Date: May 11, 2006

(65) Prior Publication Data

US 2009/0202373 A1 Aug. 13, 2009

Related U.S. Application Data

(60) Provisional application No. 60/624,251, filed on Nov. 2, 2004.

(51) Int. Cl.
*F04B 35/00* (2006.01)

(52) U.S. Cl.
USPC ..... 417/363

(58) Field of Classification Search
USPC ..... 417/363, 416–418, 423.14, 902; 267/156, 155, 166, 166.1; 29/888.022; 248/638, 624; 188/378, 379
See application file for complete search history.

(56) References Cited

U.S. PATENT DOCUMENTS

| | | | | | |
|---|---|---|---|---|---|
| 3,490,684 | A | * | 1/1970 | Meijer et al. | 417/417 |
| 3,493,168 | A | * | 2/1970 | Valbjorn | 417/415 |
| 3,947,155 | A | * | 3/1976 | Bidol | 417/417 |
| 4,778,159 | A | * | 10/1988 | Cooper | 267/151 |
| 5,522,214 | A | * | 6/1996 | Beckett et al. | 60/517 |
| 5,525,845 | A | * | 6/1996 | Beale et al. | 310/30 |
| 5,704,771 | A | * | 1/1998 | Fujisawa et al. | 417/417 |
| 5,984,233 | A | * | 11/1999 | Snyder et al. | 244/119 |

(Continued)

FOREIGN PATENT DOCUMENTS

| | | |
|---|---|---|
| DE | 196 51 624 | 6/1997 |
| FR | 1 180 821 | 6/1959 |
| GB | 1 222 425 | 2/1971 |
| GB | 2 108 595 | 5/1983 |
| GB | 2 246 176 | 1/1992 |

(Continued)

OTHER PUBLICATIONS

JP11117861A machine translation,Apr. 1999,Japan,Akazawa et al.*

(Continued)

*Primary Examiner* — Devon Kramer
*Assistant Examiner* — Amene Bayou
(74) *Attorney, Agent, or Firm* — Clark Hill PLC

(57) ABSTRACT

A substantially planar suspension spring for supporting a linear compressor housed within a hermetic shell. A hub portion (36) connects to the body of the compressor assembly while a spiral arm portion (38) curves around the hub portion (36) at least one full turn before attaching to the wall of the compressor housing. Provides lateral stability to the reciprocating compressor assembly while maintaining axial flexibility.

19 Claims, 3 Drawing Sheets

(56) References Cited

U.S. PATENT DOCUMENTS

| | | | | |
|---|---|---|---|---|
| 6,050,556 | A * | 4/2000 | Masuda et al. | 267/161 |
| 6,056,519 | A * | 5/2000 | Morita et al. | 417/415 |
| 6,127,750 | A * | 10/2000 | Dadd | 310/13 |
| 6,371,464 | B1 * | 4/2002 | Porche et al. | 267/166.1 |
| 6,565,332 | B2 * | 5/2003 | Kawahara et al. | 417/417 |
| 6,626,651 | B2 | 9/2003 | Akasawa et al. | |
| 6,742,998 | B2 * | 6/2004 | Kawahara et al. | 417/416 |
| 6,841,900 | B2 * | 1/2005 | Corey | 310/17 |
| 7,025,575 | B2 * | 4/2006 | Noh et al. | 417/363 |
| 2003/0015922 | A1 * | 1/2003 | Corey | 310/17 |
| 2005/0135946 | A1 | 6/2005 | Kang et al. | |
| 2005/0244290 | A1 | 11/2005 | Inagaki et al. | |

FOREIGN PATENT DOCUMENTS

| | | | |
|---|---|---|---|
| JP | 11-117861 | | 4/1999 |
| JP | 11117861 | A * | 4/1999 |
| JP | 11-324914 | | 11/1999 |
| JP | H11-324914 | A | 11/1999 |
| WO | 2004/036723 | A1 | 4/2004 |
| WO | 2004/106737 | | 12/2004 |

OTHER PUBLICATIONS

European Search Report dated Mar. 27, 2007 which issued in connection with European Application No. 970343; Four (4) pages.

* cited by examiner

SUSPENSION SPRING FOR LINEAR COMPRESSOR

This application is a National Phase of PCT/NZ2005/000288, having an International filing date of Nov. 1, 2005, which claims priority of U.S. provisional application Ser. No. 60/624,251, having a filing date of Nov. 2, 2004.

FIELD OF THE INVENTION

The present invention relates to linear compressors, and in particular linear compressors of the type suitable for use in a vapour compression refrigeration system.

BACKGROUND TO THE INVENTION

Linear compressors of a type for use in a vapour compression refrigeration system are the subject of many documents in the prior art. One such document is our co-pending PCT patent application PCT/NZ2004/000108. That specification describes a variety of developments relating to compressors, many of which have particular application to linear compressors. The present invention relates to further improvements to compressor embodiments such as are described in that patent application, which provides a general description of an example compressor to which the present invention may be applied. However the present invention may also be applied beyond the scope of the particular embodiments of linear compressor disclosed in that application. Persons skilled in the art will appreciate the general application of the ideas herein to other embodiments of linear compressors such as are found in the prior art.

The present invention relates generally to suspension springs for suspending the compressor assembly within the hermetic shell.

SUMMARY OF THE INVENTION

It is an object of the present invention to provide a suspension spring with improved characteristics with particular application to linear compressors and/or to provide refrigeration compressors incorporating such springs, or to at least provide the industry with a useful choice.

In a first aspect the invention may broadly be said to consist in a suspension spring for use in supporting a linear compressor within a hermetic shell, said spring comprising:

a body of substantially planar form having a hub portion for connection with the compressor, a spiral arm extending from said hub portion in the plane of said hub portion, said spiral arm curving around said hub portion in a first direction, said arm extending greater than one complete pass around said hub portion and terminating in an attachment portion for fixing to said compressor housing.

According to a further aspect of the invention, said arm is singular and is the only said connection between said hub portion and said attachment portion.

According to a further aspect of the invention, said hub portion includes means for connection to said compressor assembly. Said means may for example be one or more apertures by which said compressor may be bolted or otherwise fixed to said hub portion, or could alternatively be a clip pressed from the plane of the sheet material constituting the suspension spring.

According to a further aspect of the invention, said arm leaves said hub portion in a direction substantially tangential with the perimeter of said hub portion and follows the path of a gradually expanding spiral to said attachment portion.

According to a further aspect of the invention, said attachment portion comprises a tab extending substantially radially with respect to said spiral.

According to a further aspect of the invention, said tab includes means for attachment to said housing. The means for attachment may comprise, for example, an aperture, slot or other deformity for assisting fixing to the housing by, for example, rivet, screw, adhesive or weld.

According to a further aspect of the invention, said spring is cut from a thin flat plate of high carbon steel, pre-hardened and tempered.

According to a further aspect of the invention, said spiral arm has a width, taken in a substantially radial direction with respect to said spiral, increasing from a minimum where the arm leaves said hub portion to a maximum adjacent said attachment portion.

According to a further aspect of the invention, said tab includes a bend across it, such that a portion of said tab distal from said hub portion of said spring lies generally in a plane that is at a substantial angle to the plane of the hub portion and spiral arm of said spring.

According to a further aspect of the invention, said spring arm includes a tuning mass at a location along said arm intermediate between said hub portion and said attachment portion.

According to a further aspect of the invention, said tuning mass comprises a short length of said arm substantially wider than the adjacent parts of said arm.

In a further aspect the present invention may broadly be said to consist in a refrigeration system compressor comprising a hermetic housing, a linear compressor within said hermetic housing, said compressor including at least two relatively reciprocating parts, with one part typically being much greater mass than the other part, the relative reciprocation of the centre of mass of each part occurring along an axis of reciprocation, and at least a pair of suspension springs substantially as set forth in one or more of the above paragraphs, the hub portion of each said suspension spring being connected with said compressor part of greater mass, such that the centre of said spiral at least substantially coincides with said axis of reciprocation, and the attachment portion of each said spring being fixed to one part of said hermetic housing.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

DETAILED DESCRIPTION

Figure 1:
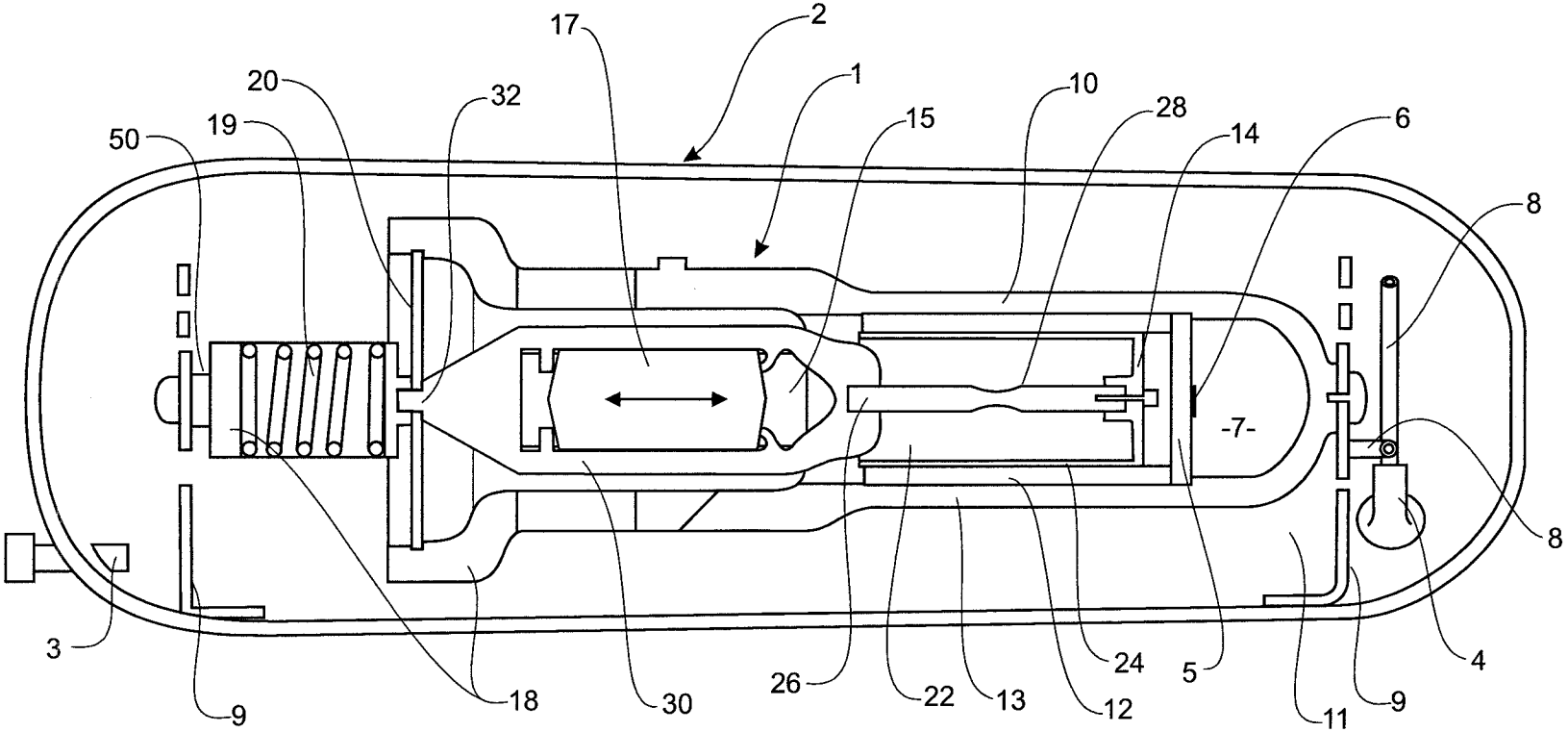
FIG. 1 is a side elevation in cross-section of a refrigeration compressor including a linear compressor suspended in a housing. The compressor is suspended in the housing at each end by a suspension spring according to a preferred embodiment of the present invention.

Referring to FIG. 1, the compressor for a vapour compression refrigeration system includes a linear compressor 1 supported inside a housing 2. Typically the housing 2 is hermetically sealed and includes a gases inlet port 3 and a compressed gases outlet port 4. Uncompressed gases flow within the interior of the housing surrounding the compressor 1. These uncompressed gases are drawn into the compressor during intake stroke, compressed between the piston crown 14 and valve plate 5 on the compression stroke, and expelled through discharge valve 6 into a compressed gases manifold 7. Compressed gases exit the manifold 7 to the outlet port 4 in the shell through a flexible tube 8. To reduce the stiffness effect of discharge tube 8 the tube is preferably arranged as a loop or spiral transverse to the reciprocating axis of the compressor. The intake to the compression space may be through the piston (with an aperture and valve in the crown) or through the head, divided to include suction and discharge manifolds and valves.

The illustrated linear compressor 1 has, broadly speaking, a cylinder part and a piston part connected by a main spring. The cylinder part includes cylinder chassis 10, cylinder head 11, valve plate 5 and a cylinder liner 12. It also includes stator parts 15 for a linear electric motor. An end portion 18 of the cylinder part, distal from the head 11, mounts the main spring relative to the cylinder part. In the illustrated embodiment the main spring is a combination of coil spring 19 and flat spring 20.

The piston part includes a hollow piston 22 with sidewall 24 and crown 14. A rod 26 connects between the crown 14 and a supporting body 30 for linear motor armature 17. The rod 26 has a flexible portion 28 approximately at the centre of the hollow piston 22. The linear motor armature 17 comprises a body of permanent magnet material (such as ferrite or neodymium) magnetised to provide one or more poles directed transverse to the axis of reciprocation of the piston within the cylinder liner. An end portion 32 of armature support 30, distal from the piston 22, is connected with the main spring 19, 20.

This briefly describes a linear compressor of a type for which the suspension spring of the present invention is useful. However it will be appreciated that the usefulness of the suspension spring of the present invention is not restricted to linear compressors of the type and configuration illustrated. It is generally applicable where operation of the linear compressor results in the relative reciprocation of the centre of mass of the piston carrying part and the centre of mass of the cylinder part along the linear axis.

The suspension spring of the present invention is most usefully applied to support the heavier of the relatively moving assemblies, typically the cylinder part assembly. In the preferred manner, such as illustrated in FIG. 1, a suspension spring 9 is provided at each extreme end of the compressor. This is so that a centre of the suspension spring 9 can be aligned with the axis of relative reciprocation of the centres of mass of the two main assemblies.

Figure 2:
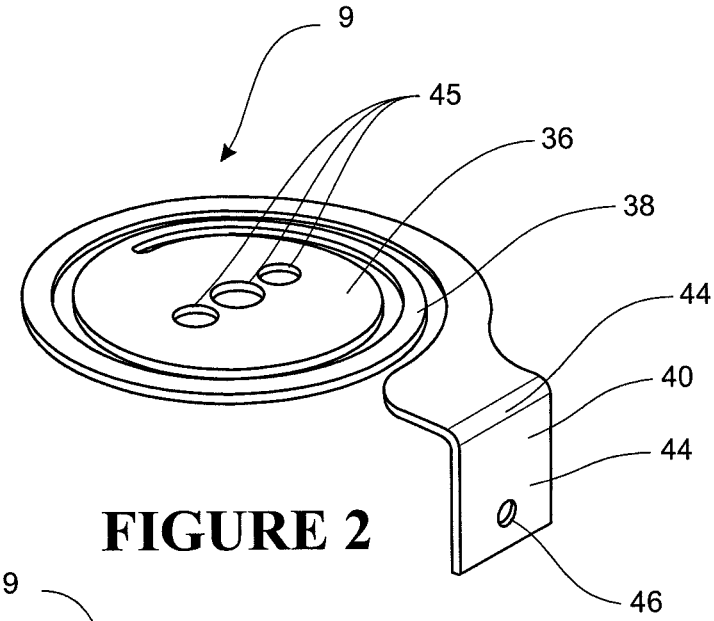
FIG. 2 is a perspective view of a suspension spring according to a first embodiment of the present invention.
Figure 4:
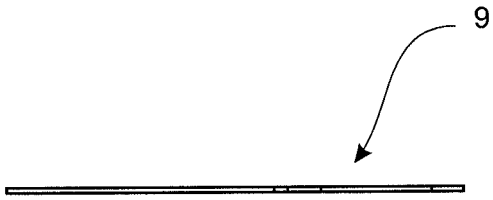
FIG. 4 is a side elevation of the blank of FIG. 3.

Referring to FIGS. 2 and 4 the suspension spring 9 of the preferred embodiment of the present invention has a hub portion 36 and a spring arm 38 extending from the hub portion 36. The spring arm 38 terminates in an attachment portion 40. The hub portion 36, spring arm 38 and attachment portion 40 are preferably integrally formed. The whole component may, for example, formed from a flat sheet material of suitable elastic property. An example of a suitable material is 0.8 mm thick sheet of T302 spring steel.

The precise shape or form of hub portion 36 is not critical although a generally circular or volute shape is preferred to provide a suitably large flat area to clamp the hub portion 36 to the compressor end.

Figure 3:
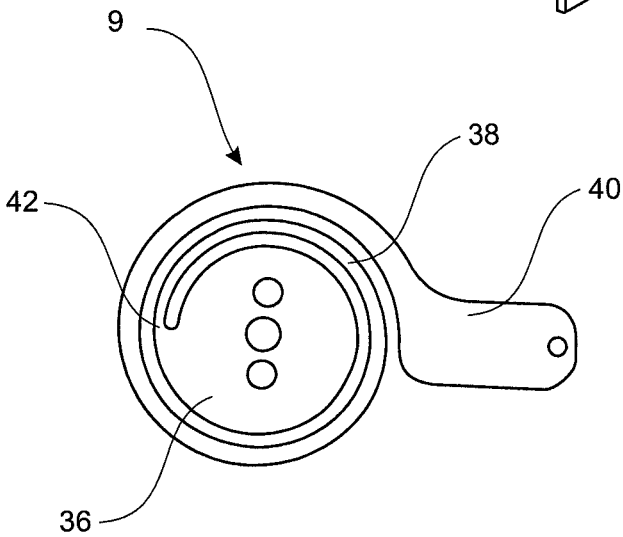
FIG. 3 is a plan elevation of a blank for forming the spring of FIG. 2.
Figure 5:
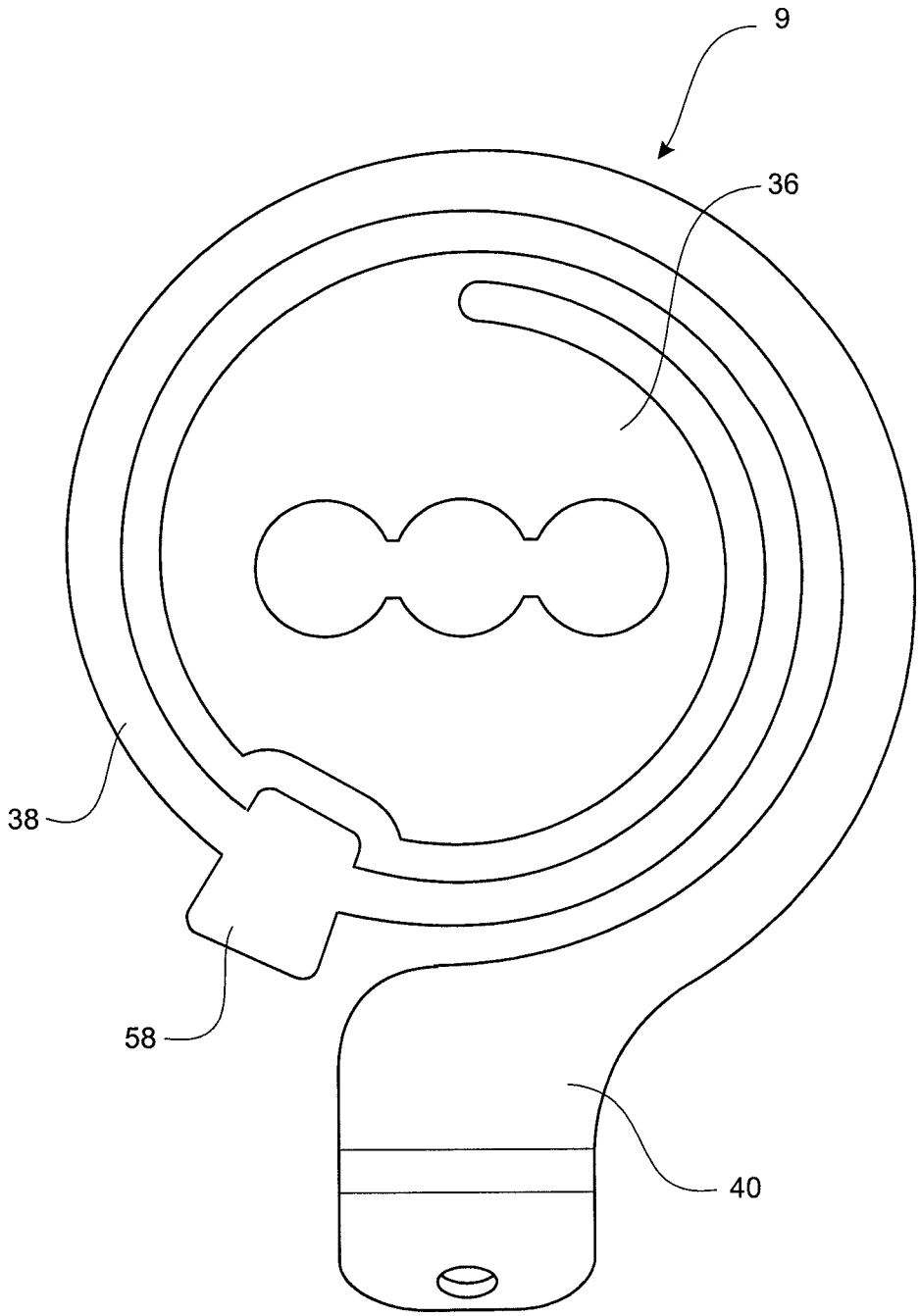
FIG. 5 is an elevation of a suspension spring including a tuning mass intermediate along the spring arm.

The spring arm 38 spirals around the hub portion 36, preferably through greater than a complete turn, staying in the same plane as the planar hub portion 36. As best seen in FIGS. 3 and 5 the spiral arm 38 is preferably tapered from one end adjacent the attachment portion 40 to the other end adjacent the hub portion 36. The spiral arm 38 merges tangentially into the hub portion 36 at end 42.

The hub portion 36 is for attachment to an end of the compressor. The hub portion 36 may include suitable feature to facilitate attachment. In the illustrated embodiments the hub portion 36 includes one or more apertures 45 which may be used to screw the spring to the compressor. To prevent gradual rotation of the compressor about its axis the two outer holes may be used at one end (as at end 50 in FIG. 1) and the central hole used at the other end (as at end 52 in FIG. 1). A flexible, for example rubber, grommet may be provided as desired. Other forms of connections such as clip or adhesive fixing are also possible.

The attachment portion 40 is for mounting the spring to the housing. Typically the spring will be mounted to the lower internal surface of the housing. For that application the attachment portion 40 may, as illustrated, include an extended tab bent to a suitable angle such that with the bent tab flush against the housing the main planar portion of the suspension spring extends away from the housing at an angle to be perpendicular to the axis of reciprocation of the compressor. So, for example, the angle at which the tab 46 is bent through at bend 44 will depend on the slope of the part of the surface of the housing to which the tab 44 is to be fixed. The attachment portion 40 (or tab 44) may be attached to the housing in any convenient fashion so that the planar portion of the support spring is cantilevered from the housing. For this the tab 44 may include suitable features to facilitate attachment. For example, for attachment to the housing by a fastener, or to provide keying for attachment by an adhesive, the tab 44 may include an aperture 46. Alternatively the tab may include one or more protrusions or dimples to facilitate spot welding or projection welding to the housing.

When suspension of the compressor in the housing is by a conventional coil spring there is the disadvantage that when the coil springs are made soft to minimise vibration along the axis of the compressor they allow too much movement at right angles to this axis. This can compromise robustness during transport and handling of the compressors or the appliance in which they are fitted. Conventional coil springs can also be noisy as in use they tend to slide over the snubbers that locate them at each end.

The spiral flat spring of the present invention, when carefully designed, is very soft in the axis of reciprocation and stiff in directions transverse to this axis. Accordingly it does not compromise between isolation and robustness.

One possible disadvantage is the many modes of resonance a spring of this type can have. Such a spring, when designed to be very soft in the direction of axial movement, will have low fundamental frequencies, (e.g. a frequency below 50 hz for all six rigid body modes) and will also have a large number of higher mode resonant frequencies where the spring vibrates within itself. Our linear compressor is also based around a resonance spring system. In preferred embodiments that we use the compressor runs at a varying natural frequency due to the variable stiffness of the compressed gas associated with the current running conditions. The compressor resonant system allows the compressor to move almost sinusoidally but there are higher order harmonics due mainly to the non linearity of the compressed gas stiffness. These higher harmonics can excite resonance in the suspension spring. Accordingly, it is important that the spring design is such that internal resonances of the suspension spring do not coincide with the running frequency or low order harmonics of the compressor.

If this interference cannot be avoided it is possible to add a mass at an appropriate point on the spring so that the resonant frequency of one internal resonance mode (which would otherwise be excited by the compressor operation) is reduced. The mass can be an additional quantity of spring material, or an added mass such as a piece of polymer which is dense and has high internal damping. Additional spring material may be included for example by providing a short wide portion 58 along the spiral arm 38 at a location between the end joining into the hub portion 36 and the end joining to the attachment portion 40. The mass is located at a point expected to exhibit maximum amplitude in the problematic resonant mode.

The invention claimed is:

1. An assembly comprising:

a hermetic shell;

a linear compressor within said hermetic shell, said linear compressor comprising a piston part reciprocating within a cylinder part along an axis; and a suspension spring formed of a substantially planar hub portion connected to the cylinder part, said hub portion defining a perimeter, a single spiral arm having first and second opposite ends, said first end of said spiral arm connected to said hub portion, said spiral arm extending from said first end and around said perimeter of said huh portion and extending in the same plane as said huh portion, said spiral arm extending greater than one complete pass around said perimeter of said hub portion, and an attachment portion provided at said second end of said spiral arm, said attachment portion is fixed to said hermetic shell, said single spiral arm forming the only connection between said hub portion and said attachment portion, said suspension spring having a stiffness in the direction of the axis of reciprocation of said linear compressor lower than a stiffness in a direction transverse to the axis of reciprocation, so that said suspension spring has a lowest fundamental frequency below 50 Hz.

2. An assembly as claimed in claim 1, wherein said hub portion includes means for connection to said cylinder part.

3. An assembly as claimed in claim 2, wherein said means for connection includes one or more apertures.

4. An assembly as claimed in claim 1, wherein said spiral arm extends from said huh portion in a direction substantially tangential with the perimeter of said hub portion and follows a path of a gradually expanding spiral to said attachment portion.

5. An assembly as claimed in claim 1, wherein said attachment portion comprises a tab extending substantially radially with respect to said spiral arm.

6. An assembly as claimed in claim 5 wherein said tab includes means for attachment to said hermetic shell.

7. An assembly as claimed in claim 5, wherein said tab includes a bend, such that a portion of said tab distal from said hub portion lies generally in a plane that is at a substantial angle to the plane of the huh portion and said spiral arm.

8. An assembly as claimed in claim 1, wherein said spring comprises a thin flat plate of high carbon steel, pre-hardened and tempered.

9. An assembly as claimed in claim 8, wherein said hub portion includes a clip extending from the plane of the thin flat plate.

10. An assembly as claimed in claim 1, wherein said spiral arm has a width, taken in a substantially radial direction with respect to said spiral, increasing from a minimum where the spiral arm leaves said hub portion to a maximum adjacent said attachment portion.

11. An assembly as claimed in any one of claims 1 and 2 to 10, wherein said spiral arm includes a tuning mass at a location along said spiral arm intermediate between said hub portion and said attachment portion.

12. An assembly as claimed in claim 11, wherein said tuning mass comprises a short length of said spiral arm substantially wider than the adjacent parts of said spiral arm.

13. An assembly as claimed in claim 11, wherein said tuning mass comprises a short length of said spiral arm substantially wider than the adjacent parts of said spiral arm.

14. An assembly as claimed in claim 1, wherein said cylinder part is of greater mass than the piston part, the relative reciprocation of the centre of mass of each part occurring along said axis of reciprocation, and a further suspension spring formed of a substantially planar hub portion and a single spiral arm, said huh portion of said further suspension spring connected to the linear compressor, said huh portion of said further suspension spring defining a perimeter, said single spiral arm of said further suspension spring having first and second opposite ends, said first end of said spiral arm of said further suspension spring connected to said hub portion of said further suspension spring, said spiral arm of said further suspension spring extending from its first end and around said perimeter of said hub portion of said further suspension spring and extending in the same plane as said huh portion of said further suspension spring, said spiral arm of said further suspension spring extending greater than one complete pass around said perimeter of said hub portion of said further suspension spring, and an attachment portion fixed to said hermetic shell and provided at said second end of said spiral arm of said further suspension spring, said single spiral arm of said further suspension spring forming the only connection between said hub portion of said further suspension spring and said attachment portion provided at said second end of said spiral arm of said further suspension spring, said further suspension spring having a stiffness in the direction of the axis of reciprocation of said linear compressor lower than a stiffness in a direction transverse to the axis of reciprocation, so that said further suspension spring has a lowest fundamental frequency below 50 Hz.

15. An assembly as claimed in claim 1, wherein said spiral arm defines a first fu turn extending completely around the perimeter of said hub portion and a second partial turn extending from said first turn and extending partially around said first turn, said second partial turn lies adjacent to a portion of said first turn, said second turn terminating in said second end, said first turn having inner and outer edges, said inner edge of said first turn being separated from said hub portion by a gap along the entire length thereof', said second turn having inner and outer edges, said inner edge of said second turn being separated from said outer edge of said portion of said first turn by a gap along the entire length thereof.

16. An assembly as claimed in claim 15, wherein said spiral arm extends from said hub portion in a direction substantially tangential with the perimeter of said huh portion and follows the path of a gradually expanding spiral to said attachment portion.

17. An assembly as claimed in claim 16, wherein said attachment portion comprises a tab extending radially with respect to said spiral arm said tab includes a bend, such that a portion of said tab distal from said hub portion lies generally in a plane that is at a substantial angle to the plane of the hub portion and said spiral arm.

18. An assembly as claimed in claim 15, Wherein said spiral arm has a width, taken in a substantially radial direction with respect to said spiral, increasing from a minimum where the spiral arm leaves said hub portion to a maximum adjacent said attachment portion.

19. An assembly as claimed in claim 15, wherein said spiral arm includes a tuning mass at a location along said spiral arm intermediate between said hub portion and said attachment portion.

* * * * *

UNITED STATES PATENT AND TRADEMARK OFFICE

CERTIFICATE OF CORRECTION

PATENT NO. : 8,678,782 B2
APPLICATION NO. : 11/577347
DATED : March 25, 2014
INVENTOR(S) : John Julian Aubrey Williams et al.

It is certified that error appears in the above-identified patent and that said Letters Patent is hereby corrected as shown below:

On the title page item (73) Assignee: "Fishe & Paykel Appliances Limited" should be -- Fisher & Paykel Appliances Limited --

Signed and Sealed this
Ninth Day of September, 2014

Michelle K. Lee

Michelle K. Lee
*Deputy Director of the United States Patent and Trademark Office*